US005778502A

United States Patent [19]

Voigtländer et al.

[11] Patent Number: 5,778,502

[45] Date of Patent: Jul. 14, 1998

[54] DEVICE FOR CRIMPING SYNTHETIC THREAD BUNDLES OR BANDS

[75] Inventors: Carsten Voigtländer, Neumünster; Uwe Münster, Wilster, both of Germany

[73] Assignee: NEUMAG-Neumunstersche Maschinen-und Anlagenbau GmbH, Neumunster, Germany

[21] Appl. No.: 728,934

[22] Filed: Oct. 11, 1996

[30] Foreign Application Priority Data

Oct. 12, 1995 [DE] Germany ..... 195 37 958.6

[51] Int. Cl.[6] ..... D02G 1/12

[52] U.S. Cl. ..... 28/269; 28/263

[58] Field of Search ..... 28/247, 262, 263, 28/268, 269, 270

[56] References Cited

U.S. PATENT DOCUMENTS

| | | | |
|---|---|---|---|
| 3,618,183 | 11/1971 | Funk et al. | 28/269 |
| 4,807,337 | 2/1989 | Fleissner | 28/269 |

FOREIGN PATENT DOCUMENTS

| | | | |
|---|---|---|---|
| 2117393C3 | 7/1980 | Germany | 28/269 |
| 3212636A1 | 10/1983 | Germany | 28/269 |
| 3626522 | 2/1988 | Germany | 28/269 |
| 4229989A1 | 3/1993 | Germany | 28/269 |
| 44-19823 | 8/1969 | Japan | 28/269 |

*Primary Examiner*—C. D. Crowder
*Assistant Examiner*—Larry D. Worrell, Jr.
*Attorney, Agent, or Firm*—Michael J. Striker

[57] ABSTRACT

A device for crimping synthetic thread bundles or bands has a stuffing chamber, a pair of rollers supplying a thread bundle or band into the stuffing chambers, a pressing disk covering a roller gap at end sides of the rollers, a clamping element including and axially reciprocating piston which presses the pressing disks against the end surfaces of the rollers, a rotary drive having a drive unit for producing a reciprocating movement and an apparatus for converting the reciprocating movement in a stepped rotation of the pressing disks, the clamping element being fixedly connected with the rotary drive to form a structural group, the structural group having a single rotatably supported and axially displaceable driven element which axially engages the pressing disk and is fixedly connected with it for joint rotation, the piston of the clamping element being clampable inside the structural group axially against the driven element, the rotary drive having a swivel motor with a swiveling shaft which is reciprocatingly swivelable in a limited angular region and a free-running element arranged as a coupling between the swivel shaft and the driven element aligned with the swivel shaft.

7 Claims, 5 Drawing Sheets

DEVICE FOR CRIMPING SYNTHETIC THREAD BUNDLES OR BANDS

BACKGROUND OF THE INVENTION

The present invention relates to a device for crimping synthetic thread bundles or bands.

In devices for crimping synthetic thread bundles or bands with a stuffing chamber and a preceding roller pair, the gap provided between both rollers must be laterally sealed. This is performed by means of pressing disks which are held in contact with the side surfaces of the rollers and therefore subjected to wear. For preventing penetration of the rollers into the pressing disks, the pressing disks must be designed so that during the operation they perform a slow or intermittent rotation, preferably about an axis which is eccentrically offset relative to the roller gap. Therefore the surface portions with which the pressing disks abut against the end surfaces of the rollers continuously change. As a result, a uniform wear over the whole surface of the pressing disk is obtained.

German patent document DE-PS 21 17 393 from which the present invention proceeds describes a device in which the pressing disk is pressed with a cylinder-piston unit against the associated end surfaces of the rollers. The rotary drive for the drive disk includes a second cylinder-piston unit which is structurally separated from the first cylinder-piston unit and arranged in a recess of the side wall of the stuffing chamber. The associated piston rod is oriented substantially tangentially to the pressing disk and provided on its free end with a turnable pawl engaging in teeth of the pressing disk. The reciprocating movement of the piston is thereby converted into a stepped turning of the pressing disk.

Japanese patent document JP-AS 44-19 823 discloses the pressing disk a with rotatably supported shaft pin on which a toothed gear is arranged. The tooth gear engages with a second toothed gear which obviously belongs to a not described rotary drive. Instead of the toothed gear transmission, also a belt or chain transmission can be utilized. Also, a manual turning is possible. By a hydraulic or pneumatic clamping device with the piston rod coinciding with the shaft pin and acting on its free end, the pressing disk is pressed against the end surfaces of the rollers.

In the device disclosed in U.S. Pat. No. 3,618,183 a rotary drive with a cylinder-piston unit formed a structural group with a compact housing is fixedly screwed on the machine part. A cylinder-piston unit is accommodated in the housing. Its piston rod is oriented coaxially to the pressing disk and connected with the latter by a rotation-fixed coupling. A toothed gear is arranged on the piston rod and engages with a screw. The screw is arranged on a shaft which is supported transversely to the piston rod in the housing. A turning button is mounted on its end extending laterally outwardly.

German patent document DE-OS 42 29 989 discloses a so-called rotary-linear unit formed as a compact aggregate with a driven rod extending from its front side. It is arranged in driving connection in the interior of the housing both with a linear drive formed as a cylinder-piston unit and with a pressure medium-operated turning vane motor. The driven rod can therefore perform independently a displacement movement and a reciprocating swiveling movement. The swiveling movement is limited by an angular region depending on the geometry of the swivel vane motor and for example amounting to 272°.

German patent document DE-OS 32 12 636 discloses several pressure-medium operated aggregates, in which swivel motors of different type each provided with a linear drive are assembled to form a compact structural group. In all embodiments a single pin-shaped driven element performs both axial displacement movements and reciprocating swiveling movements.

SUMMARY OF THE INVENTION

Accordingly, it is an object of the present invention to provide a device for crimping synthetic thread bundles and bands, which is a further improvement of the existing devices.

More particularly, it is an object of the present invention to provide a device in which the elements for pressing and turning of the pressing disks have a simple, compact construction, high reliability and low costs.

In keeping with these objects and with others which will become apparent hereinafter, one feature of present invention resides, briefly stated, in a device for crimping synthetic thread bundles or bands in which the clamping element is fixedly connected with the rotary drive to one structural group, the structural group has a single rotatably supported and axially displaceable driven element which axially engages the pressing disk and is fixedly connected with it for joint rotation, the piston of the clamping element is clampable inside the structural group axially against the driven element, and the rotary drive has a swivel motor with a swiveling shaft which reciprocatingly swivels within a limited angular region and has a free-running element arranged as a coupling between the swiveling shaft and the driven element aligned with it.

In accordance with another feature of the present invention, the clamping element is located between the swivel motor and the free-running element, the piston of the clamping element has an axial opening and the swiveling shaft is slidingly guided in the opening.

In accordance with still a further feature of the present invention, a subgroup of the structural group includes the swivel motor and the clamping motor and has a single driven pin which is in driving connection in the interior of the subgroup with the piston of the clamping element and with the swiveling shaft of the swivel motor, the driven pin is clampable through an axial bearing against the driven element, and the free-running element is formed as a coupling between the driven pin and the driven element.

A special advantage of the present invention is that the required structural elements can be produced by specialized manufacturers in mass production and supplied ready for assembly.

In the claims and in the description, the term "swivel motor" means an aggregate whose driven shaft or the swiveling shaft changes its angular position relative to its geometrical axis within a limited angular region alternatingly in clockwise direction and counterclockwise direction. The term "rotary drive" means a drive which performs any progressive turning about an axis at least in one rotary direction.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
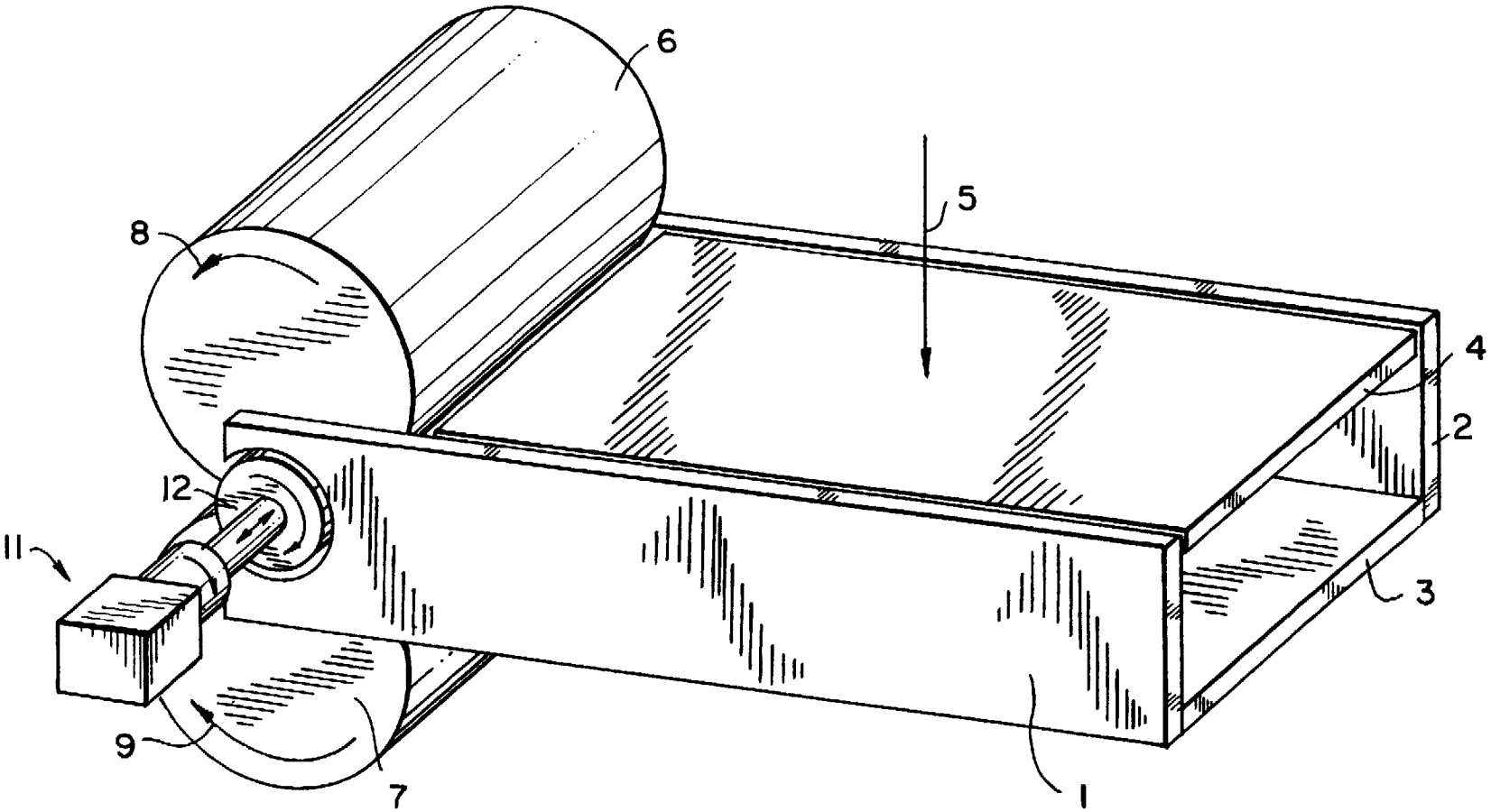
FIG. 1 is a perspective view showing a device for crimping synthetic thread bundles and bands in accordance with the present invention.

A device for crimping synthetic thread bundles or bands has an stuffing chamber which is limited by side plates 1 and 2, a bottom plate 3 and a cover plate as can be seen from FIG. 1. The bottom plate 3 is fixedly connected with the side plates 1 and 2. The cover plate 4 is turnable about a horizontal axis under the action of a force which is symbolically shown in FIG. 1 with arrow 5.

Two rollers 6 and 7 are arranged at an inlet of the stuffing chamber. They are driven by a not shown motor in a rotary direction identified with arrows 8 and 9. The end surfaces of the roller 6 and 7 extend closely to the side plates I and 2. The axes of the rollers 6 and 7 are horizontal and parallel to one another. They are arranged at such a distance from one another that a narrow gap remains between the roller 6 and 7, through which a thread bundle to be treated is pressed into the stuffing chamber.

Figure 2:
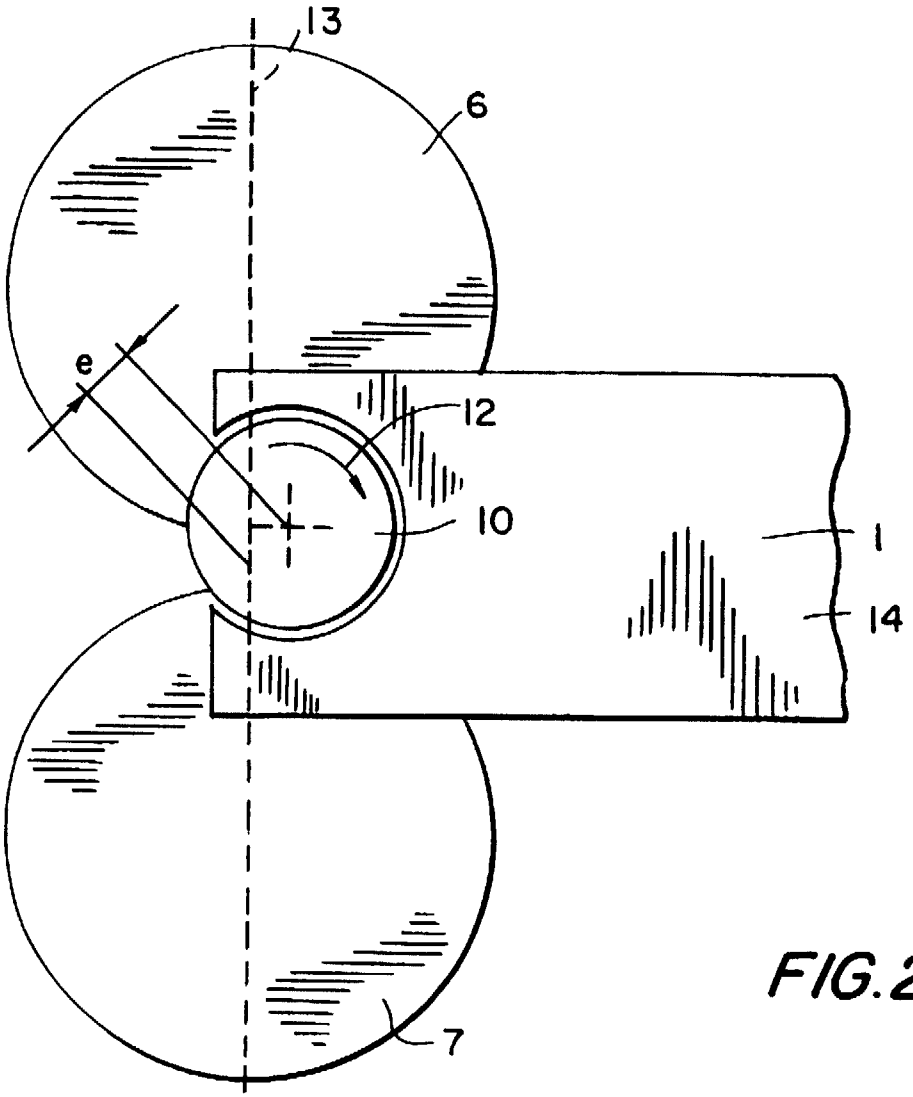
FIG. 2 is a partial view of the inventive device from a side.

The periphery of the roller gap is covered at both end sides of the rollers 6 and 7 by circular pressing disks 10 located in a recess of the side plates 1 and 2 correspondingly. The pressing disks 10 are pressable against the end surfaces of the rollers 6 and 7 by a rotary-clamping unit formed as a structural group 11 as will be described hereinbelow. The pressing disks 10 are rotatable in a stepped manner in a direction identified with arrow 12. The rotary axis of the pressing disk 10 extends parallel to the axis of the roller 6 and 7. It is preferably located eccentrically to the roller gap. In other words, it extends through the plane of FIG. 2 which contains the end surfaces of the rollers 6 and 7 at a distance from a line in which the plane 13 containing the axes of both rollers 6 and 7 intersects the plane of symmetry 14. The eccentricity E has a horizontal and a vertical component.

Figure 3:
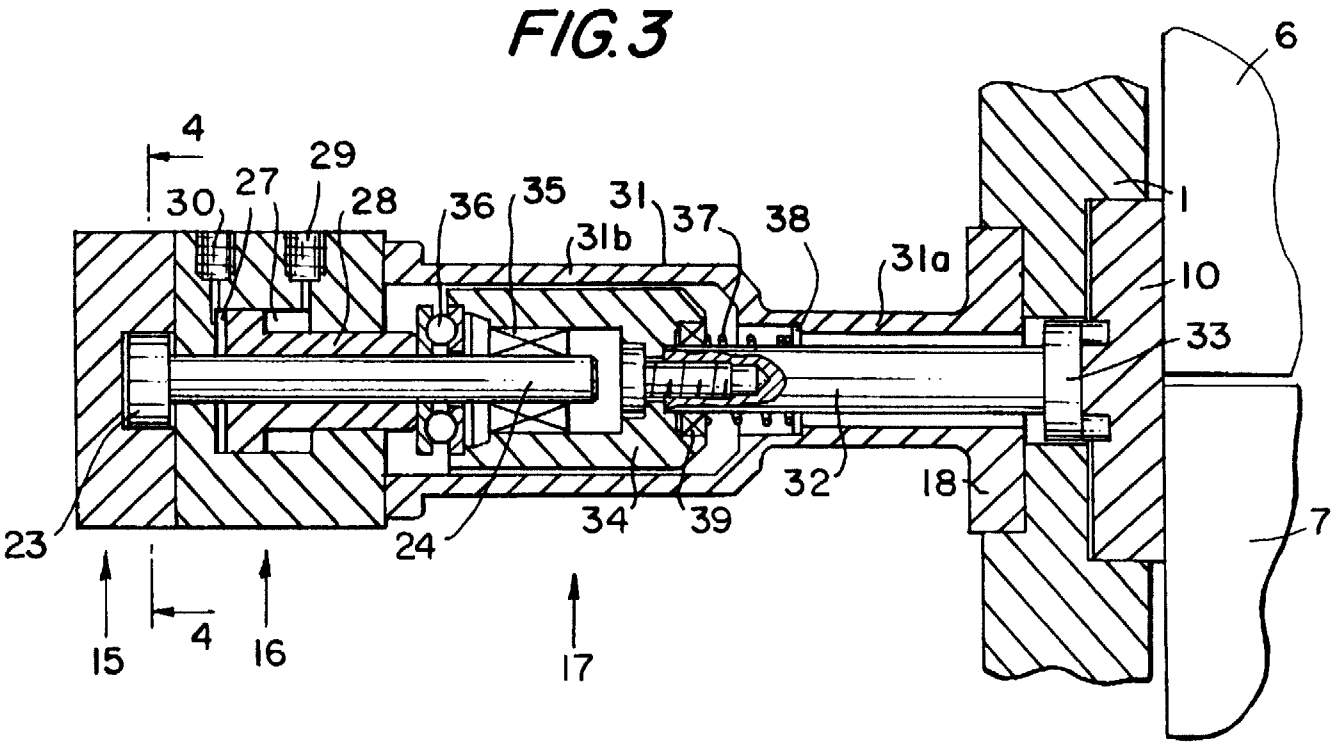
FIG. 3 is a view showing a part of the inventive device in sections.

As shown in FIG. 3, the structural group 11 includes three parts 15, 16, 17 fixedly connected with one another. They are arranged in a modular way one on the other to form a column-shaped aggregate. This aggregate is mounted by a flange 18 in a horizontal position on the side plate 1.

Figure 4:
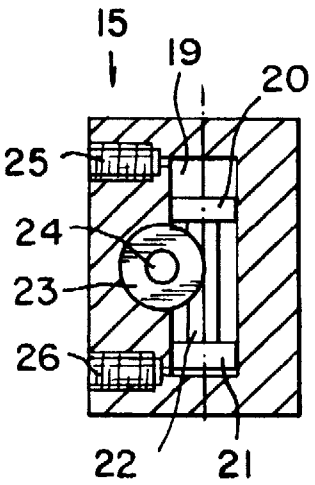
FIG. 4 is a view showing a section taken along the line 4—4 in FIG. 3.

The part 15 is a swivel motor. As shown in FIG. 4, two pistons 20 and 21 are arranged in a cylindrical hollow chamber 19 with a vertical cylinder axis and are connected with one another by a toothed rack 22. The rack engages with a pinion 23 which is arranged on a swiveling shaft 24 for joint rotation with it, and the swiveling shaft 24 extends coaxially to the pressing disk 10. Openings 25 and 26 are provided on both ends of the cylindrical hollow chamber 19. Conduits for supply and withdrawal of a pressure medium, for example air or oil, are connected with the openings. In response to the alternating loading with the pressure medium, the toothed rack 22 performs a reciprocating movement. The swiveling shaft 24 reciprocatingly swivels within a limited angular region. The size of the angular region depends on the length of the toothed rack. With a length slightly exceeding the diameter of the pinion 23, the swiveling region is approximately 120°.

The part 16 is a clamping element. It has a cylindrical hollow chamber 27 accommodating a piston 28. A piston 28 is provided with a coaxial opening. The swiveling shaft 24 is slidingly guided in a telescoping manner in the opening. It extends through the part 16 to the interior of the part 17. Connecting openings 29 and 30 for supply and withdrawal of a pressure medium are provided on both ends of the cylindrical hollow chamber 27. The piston 28 is axially reciprocatingly movable under the action of alternating loading with a pressure medium. The sliding seat of the swiveling shaft 24 makes possible relative movements both in the axial direction and in the peripheral direction.

The part 17 has a cylindrical housing 31 composed of a relatively narrow portion 31*a* which is connected with the flange 18 and an expanded portion 31 b which is fixedly screwed on the part 16. A rod 39 is accommodated in the portion 31*a* and connected by a form-locking coupling disk 33 with the pressing disk 10 for joint rotation with it. A thick-walled, cup-shaped sleeve 34 is rigidly connected with the rod 32 and accommodated in the expanded portion 31 b. The rod 32 and the sleeve 34 together form a driven element with a shape resembling a ball. The swiveling shaft 24 extends into the interior of the sleeve 34. A free-running element 35 is mounted between the swiveling shaft 24 and the inner surface of the sleeve 34 and allows a relative axial movement between the sleeve 34 and the swiveling shaft 24. The swivel motor 15 forms together with the free-running element 35 a rotary drive which provides an intermittent, stepped turning of the pressing disk 10.

The piston 28 is axially tensionable against the pressing disk 10 through the axial bearing 36 and the driven element composed of the sleeve 34 and the rod 32. A spring 37 has one end supported against a ring 38 mounted in the narrow portion 31*a* of the housing 31 and another end abutting against a bearing 39. The spring 37 is located in a ring groove on the outer side of the bottom of the sleeve 34 and presses the sleeve 34 against the piston 28. It operates so that during withdrawal of the piston 28, the sleeve 34 and the rod 32 can be also displaced so that the coupling disk 33 moves out of the pressing disk 10.

Figure 5:
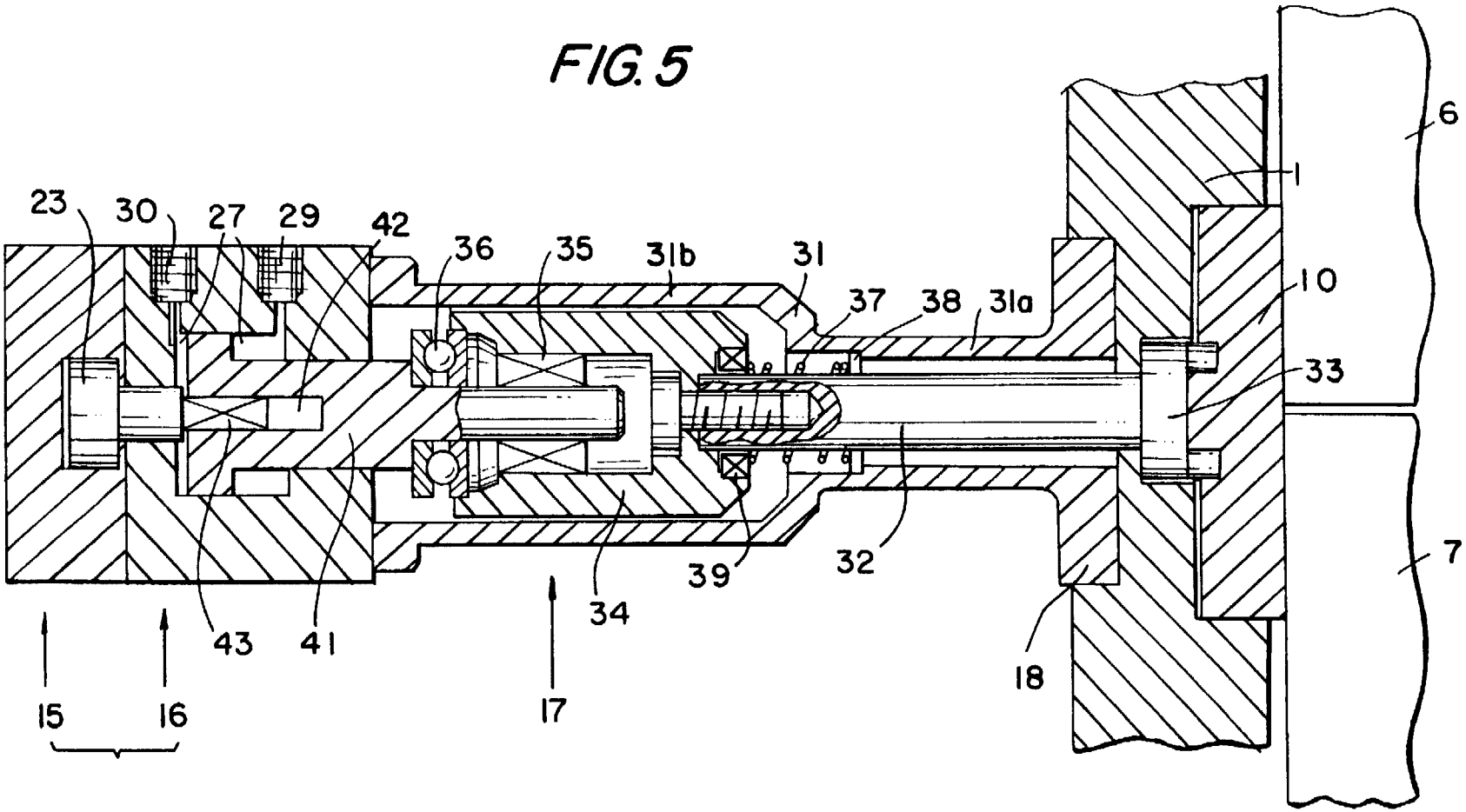
FIG. 5 is a view substantially corresponding to the view of FIG. 3 but showing another embodiment of the present invention.

In FIG. 5 the parts which are provided with reference numerals mentioned in FIGS. 1–4 correspond to the part shown in other Figures and identified with the same reference numerals.

In the embodiment of FIG. 5, the parts 15 and 16 form a subgroup 40 which has a single driven pin 41 extending in the part 17. The piston of the clamping element 11 is formed as a joint driven pin 41. A swiveling shaft 43 extends into a recess 42 of the driven pin 41 and forms with the pinion 23 of the swivel motor 15 as a rigid unit. A rotation-transmitting connection is provided between the swivel shaft 43 and the driven pin 41, for example by a recess 42 having a cross-section deviating from a circular shape and a swivel shaft 43 form-lockingly engaging in it. This connection provides for a sliding axial movement of the driven pin 41 relative to the swiveling shaft 43. The driven pinion 41 has a coaxial end piece 41 a with reduced diameter. The driven pin 41 abuts against the axial bearing 46 with a ring-shaped shoulder which forms a transition to the end piece 41*a*. The end piece 41*a* extends in the sleeve 34. A free-running element 35 is mounted in the ring chamber between the end piece 41*a* and the inner sleeve surface of the sleeve 34.

Figure 6:
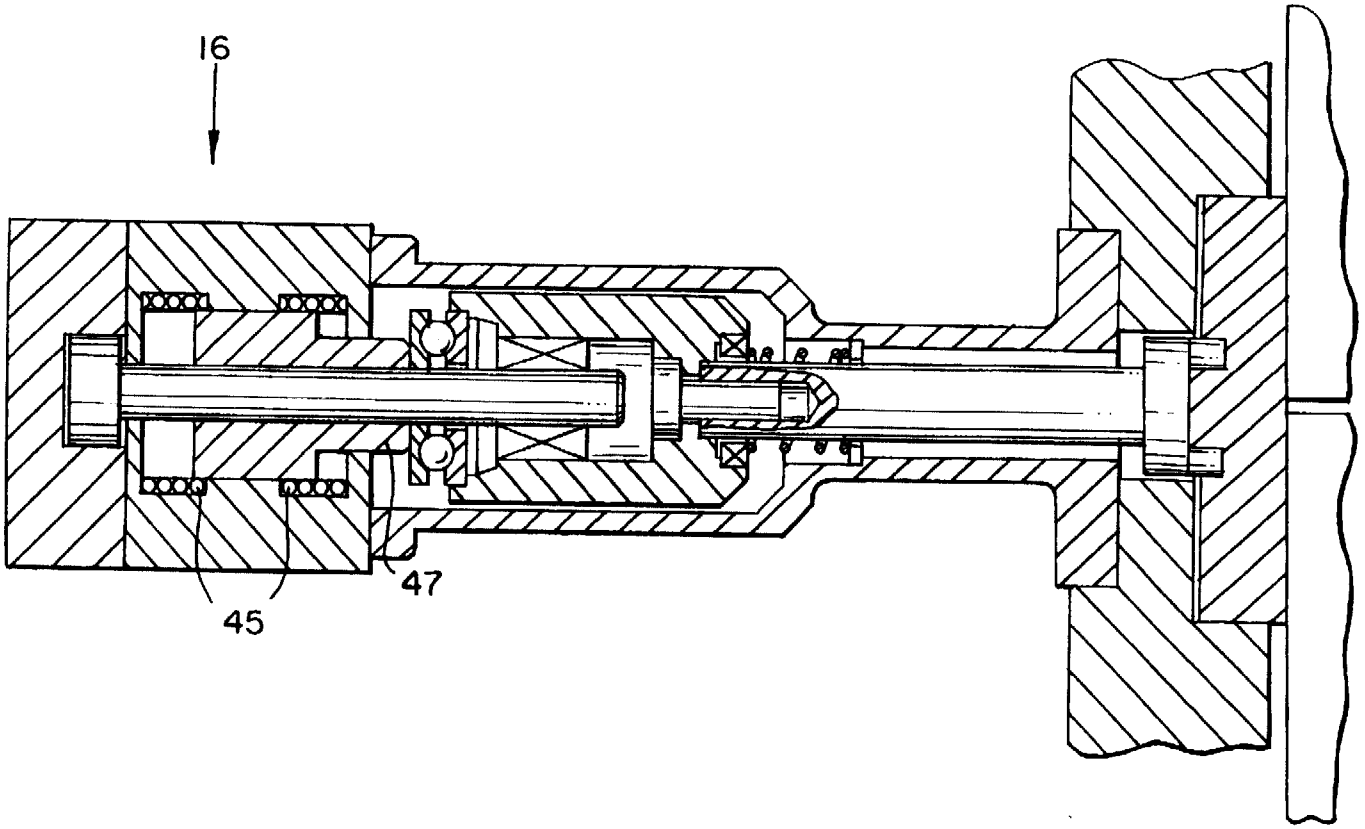
FIG. 6 is a view substantially corresponding to the view of FIG. 3 but showing a further embodiment of the present invention.
Figure 7:
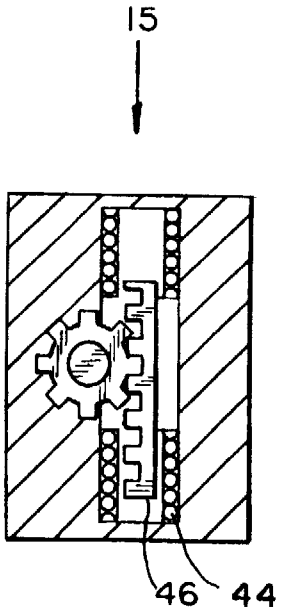
FIG. 7 is a view showing an embodiment of FIG. 6 in a section analagous to FIG. 4.

The embodiments shown in FIGS. 6 and 7 differs from the embodiment of FIGS. 3 and 4 since here the swivel motor 15 and the clamping element 16 are not driven by a pressure medium, but instead are driven electrically. Coils 44 and 45 which are connected with a not shown current source apply a displacement force to a toothed rack 46 of the swivel motor 15 and to a piston 47. In other aspects, the embodiments of FIGS. 6 and 7 correspond to the embodiments of FIGS. 3 and 4 and therefore any further description is superfluous.

It will be understood that each of the elements described above, or two or more together, may also find a useful application in other types of constructions differing from the types described above.

While the invention has been illustrated and described as embodied in device for crimping synthetic thread bundles or bands, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

1. A device for crimping synthetic thread bundles or bands, comprising a stuffing chamber; a pair of rollers supplying a thread bundle or band into said stuffing chamber and forming a roller gap; pressing disks covering said roller gap at end surfaces of said rollers; a clamping element including an axially reciprocating piston which presses said pressing disks against the end surfaces of said rollers; a rotary drive having a drive unit for producing a reciprocating movement; and means for converting the reciprocating movement to a stepped rotation of said pressing disks, said clamping element being fixedly connected with said rotary drive to form a structural group, said structural group having a single rotatably supported and axially displaceable driven element which axially engages said pressing disk and is fixedly connected with it for joint rotation, said piston of said clamping element being clampable inside said structural group axially against said driven element, said rotary drive having a swivel motor with a swiveling shaft which is reciprocatingly swivelable in a limited angular region and a free-running element arranged as a coupling between said swivel shaft and said driven element aligned with said swivel shaft.

2. A device as defined in claim 1, wherein said clamping element is arranged between said swivel motor and said free-running element.

3. A device as defined in claim 2, wherein said piston is provided with an axial opening, said swiveling shaft being slidingly guided in said opening.

4. A device as defined in claim 1, wherein said group has a subgroup including said swivel motor and said clamping element and having a single driven pin, said driven pin being in a driving connection with said piston of said clamping element and with said swiveling shaft of said swivel motor inside said subgroup.

5. A device as defined in claim 4; and further comprising an axial bearing, said driven pin being clampable through said axial bearing against said driven element.

6. A device as defined in claim 4, wherein said free-running element is formed as a coupling arranged between said driven pin and said driven element.

7. A device as defined in claim 4, wherein said piston of said clamping element is formed as said driven pin of said subgroup.

* * * * *